US006053252A

United States Patent [19]

Edwards

[11] Patent Number: 6,053,252

[45] Date of Patent: Apr. 25, 2000

[54] LIGHTWEIGHT INTERVENTION SYSTEM

[75] Inventor: Jeffrey Charles Edwards, Aberdeen, United Kingdom

[73] Assignee: Expro North Sea Limited, United Kingdom

[21] Appl. No.: 09/000,118

[22] PCT Filed: Jun. 21, 1996

[86] PCT No.: PCT/GB96/01509

§ 371 Date: Apr. 17, 1998

§ 102(e) Date: Apr. 17, 1998

[87] PCT Pub. No.: WO97/04211

PCT Pub. Date: Feb. 6, 1997

[30] Foreign Application Priority Data

Jul. 15, 1995 [GB] United Kingdom ..... 9514510

[51] Int. Cl.[7] ..... E21B 7/12

[52] U.S. Cl. ..... 166/348; 166/338; 166/368

[58] Field of Search ..... 166/348, 338, 166/339, 344, 368, 95.1, 75.11, 341

[56] References Cited

U.S. PATENT DOCUMENTS

| | | | |
|---|---|---|---|
| 4,691,780 | 9/1987 | Galle et al. | 166/348 |
| 4,721,163 | 1/1988 | Davis | 166/348 X |
| 4,749,046 | 6/1988 | Gano | 166/368 X |
| 5,372,199 | 12/1994 | Cegielski et al. | 166/368 |
| 5,941,310 | 8/1999 | Cunningham et al. | 166/345 |

FOREIGN PATENT DOCUMENTS

| | | | |
|---|---|---|---|
| WO93/24730 A1 | 12/1993 | WIPO | 166/348 |

*Primary Examiner*—Dennis L. Taylor
*Attorney, Agent, or Firm*—Gifford, Krass, Groh, Sprinkle, Anderson & Citkowshi, P.C.

[57] ABSTRACT

A lightweight intervention system is described for use with single bore and dual bore intervention operations and which can be used with both horizontal trees and conventional trees and with wellheads without trees mounted thereon. The system is based on a two-part intervention apparatus; the lower part provides the pressure control and consists of an xmas tree or wellhead connector and structural housing in which a sub-sea test tree is located and is coupled to the xmas tree and an upper part, a disconnectable section, attaches to the lower part and consists of a sub-sea test tree latch housed within an xmas tree connector and additional pressure control equipment as required. This general structure can be configured in various ways to create different embodiments for use with horizontal trees and conventional trees which have a single through-bore requirement and a dual bore requirement respectively. With horizontal trees access to the annulus space depends on the type of proprietary valve system used in the tree. The intervention apparatus may also be used directly on wellheads where the tree has been removed.

14 Claims, 4 Drawing Sheets

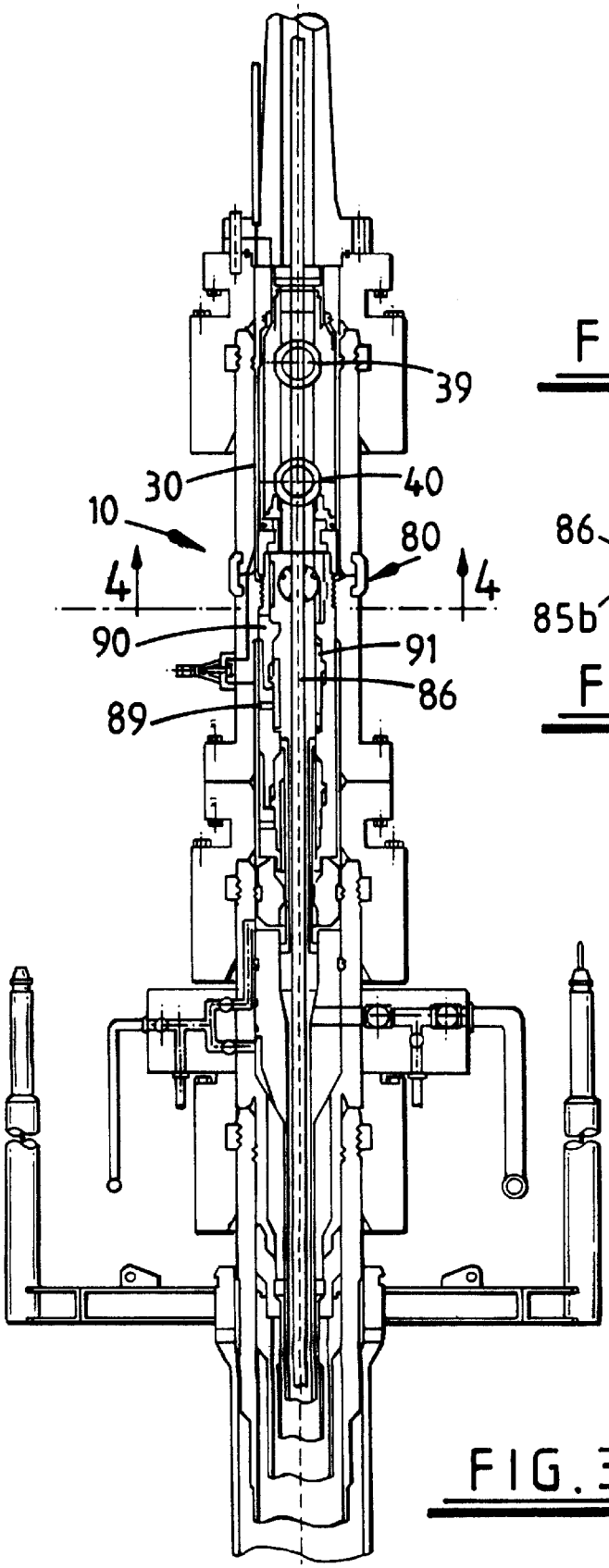
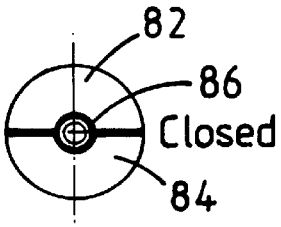
FIG. 4b
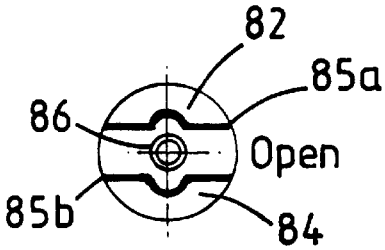
FIG. 4a
FIG. 3

LIGHTWEIGHT INTERVENTION SYSTEM

FIELD OF THE INVENTION

The present invention relates to well intervention systems. In particular, the invention relates to intervention systems for use on sub-sea wells.

At the present time, the number of well intervention operations on sub-sea wells is relatively few. However, interventions on platform based wells have contributed to considerable increases in production. Therefore, if the cost of sub-sea interventions is reduced there will be a considerable saving to industry.

DESCRIPTION OF THE RELEVANT PRIOR ART

An area which has a major cost implication in both capital and running costs is the system for monitoring pressure control during intervention on a sub-sea well. In the drilling mode this equipment comprises a blow out preventer (BOP) stack, a disconnectable lower marine riser package and a marine riser system. For well intervention through the sub-sea xmas tree a different pressure control system is used, comprising a safety package to contain the well, a disconnectable riser package and a dual workover riser system. These require complex and expensive handling and running system which occupies a large space on board the vessels which may cause problems with regard to storage of other equipment. If a cost effective and economic alternative to a traditional rigged-based BOP system or industry standard workover riser systems can be derived, then this would offer significant advantages.

Accordingly, several major operators are currently reviewing the feasibility of conducting well intervention operations from lightweight semi-submersible and mono-hull DP vessels for the purposes of well surveillance and management. Cost evaluations of this type of intervention indicate that saving of at least 40–50% are achievable compared with utilising a semi-submersible. If such a vessel could be used it would offer significant advantages in flexibility and speed of manoeuvre to different locations and could also be used for additional uses such as well testing or coiled tubing drilling.

Two existing through-BOP stack intervention systems have recently been disclosed; one in applicant's co-pending U.K. Application No. 9509547.7 for a 5"×2" dual bore completion tree, and the other in U.K. 9505129.8 for a 5" and 7" monobore system for horizontal/spool trees. These BOP stack intervention systems enable completion/intervention operations to be conducted prior to a conventional tree being deployed or, in the case of a horizontal tree, during the completion and intervention phase. Both systems bring considerable advantages to the operator. Such systems are beginning to be deployed in the industry.

Dual bore skeletal workover risers are used in two roles. Firstly, within the marine riser to run and retrieve the well completion tree and, secondly, to deploy the xmas tree and intervention equipment in open water. In both cases the equipment provides the well control functions required in a well intervention role.

With the marine riser, the through riser equipment is not subjected to open water environmental loads and, consequently, does not have to offer the structural integrity to resist the bending and tensile forces experienced in an open water environment but the equipment does provide the well control functions required in a well intervention role.

It is desirable to create a system which offers all the functions of both a through-BOP and open water system but provide a lightweight intervention role, that is one without a BOP stack, which was hitherto not available or possible with existing systems.

SUMMARY OF THE INVENTION

This is achieved by providing a lightweight intervention system for use with single bore and dual bore intervention operations and which can be used with both horizontal trees and conventional trees and with wellheads without trees mounted thereon. The system is based on a two-part intervention apparatus; the lower part provides the pressure control and consists of a xmas tree or wellhead connector and structural housing in which a sub-sea test tree is located and is coupled to the xmas tree and an upper part, a disconnectable section, attaches to the lower part and consists of a sub-sea test tree latch housed within a xmas tree connector and additional pressure control equipment as required.

This general structure can be configured in various ways to create different embodiments for use with horizontal trees and conventional trees which have a single through-bore requirement and a dual bore requirement respectively. With horizontal trees access to the annulus space depends on the type of proprietary valve system used in the tree. The intervention apparatus may also be used directly on wellheads where the tree has been removed.

With the horizontal tree annulus access may be required so that pumping or stimulation operations can be performed and fluid returns monitored and controlled at surface. In some cases, the annulus access is located beneath the horizontal tree cap. This requires a bridge arrangement run on a wireline to straddle the tree cap and tubing hanger and establish an annular chamber providing a second flow path through the tree cap.

The establishment of this chamber establishes the communication path between the annulus in the tree, the intervention system and the main bore, being separate from the annulus. With such an arrangement communication into the annulus space is achieved by movement of a sliding sleeve valve in the seal stinger which is opened hydraulically to allow the passage of fluid.

When the lightweight intervention system is used with a conventional parallel bore system, annulus communication is provided through a separate annulus bore in the intervention system and no bridge is required.

In a further arrangement, the intervention apparatus is modified to include a coiled tubing grip and seal device in the event that the coiled tubing requires to be cut by the sub-sea test tree. In this case, pressure isolation is achieved via a pair of half-shell elements working in a clam-shell fashion to grip and seal cut coiled tubing.

According to a first aspect of the present invention, there is provided lightweight intervention apparatus for use with a horizontal tree having a main bore and a separate annulus bore, said intervention apparatus comprising:

first connection means for connecting said intervention apparatus to said horizontal tree, housing means coupled to said first connection means, second connection means coupled to said housing means, said second connection means having a quick-connect/quick-disconnect facility, sub-sea test tree means located in said housing means in proximity to said second connection means, tree cap intervention tool means disposed in said housing means beneath said sub-sea test tree, said intervention apparatus providing main bore communication from a riser to said horizontal tree, said tree cap intervention tool means having valve means for providing annulus communication from said annulus line in said horizontal tree.

Preferably, the valve means connects the annulus line to an annulus valve located in the intervention apparatus.

According to a second aspect of the present invention, there is provided lightweight intervention apparatus for use with a horizontal tree having a main bore and an annulus bore, said lightweight intervention apparatus comprising:

a first connector means for connecting the intervention apparatus to the horizontal xmas tree, housing means coupled to the first connector means at one end and to second connector means at its other end, said second connector means being a quick-connect/disconnect connector and being adapted to be so connected to a riser stress joint, said housing means defining an interior bore in which is disposed at an upper end a sub-sea test tree and at a lower end a proprietary tree cap intervention tool selected so as to co-operate with a proprietary tubing hanger disposed in said horizontal tree, said proprietary tree cap intervention tool having coupling means for coupling with the production bore in said horizontal tree, and bridge means adapted to be disposed within said tree cap intervention tool to provide a communication channel between said annulus bore in the tree and the exterior of said housing and for isolating said annulus from said main bore.

Preferably, said annulus coupling means is separately actuatable to provide said selectible communication between said annulus bore in said tree and the exterior of said housing when said bridge means is in place.

Preferably also, said sub-sea test tree has at least two spaced valves in said bore. Conveniently, said spaced valves are ball valves.

Conveniently also, said housing is a two part housing having a lower housing part for receiving said proprietary or tree cap intervention tool and an upper housing part for receiving said sub-sea test tree. The sub-sea test tree is a standard available 5" or 7" test tree (Expro North Sea Limited).

Conveniently also, the bottom horizontal tree connector is a 18¾" connector which is hydraulically actuatable to couple to the xmas tree mandrel.

The proprietary tree cap intervention tool is selected for the particular tree cap which is used.

Preferably also, the sub-sea test tree has two ball valves which are located in series and which are independently actuatable.

Preferably also, the intervention apparatus includes coiled tubing clamping means disposed within said housing, said coiled tubing clamping means being actuatable to clamp said coiled tubing in the event of said sub-sea tree being actuated to close said ball valves and cut said coiled tubing.

Conveniently, said coiled tubing clamping apparatus is provided by a pair of half shell elements which clamp around the coiled tubing.

According to a further aspect of the present invention, there is provided a coiled tubing grip and seal mechanism for use with a lightweight intervention system, said coiled tubing grip and seal mechanism being adapted to be disposed in the main bore of said lightweight intervention apparatus, said mechanism comprising coiled tubing gripping means which is actuatable between a first position where said coiled tubing is ungripped and a second position whereby said coiled tubing is gripped, said mechanism being actuatable in response to said coiled tubing being cut above said grip and seal mechanism so as to grip said tubing and prevent it from falling into said well.

Preferably, said coiled tubing gripping means is provided by a pair of half shell elements disposed in a clam shell-like arrangement within the main bore of said lightweight intervention apparatus.

Conveniently, said grip and seal mechanism can be used for gripping and sealing other tubing and wirelines passing through said bore.

According to a further aspect of the present invention there is provided an annulus bridge apparatus for use with a lightweight intervention system to provide communication from the annulus in a horizontal tree having a tree cap and a tubing hanger disposed beneath the tree cap to an annulus line in the lightweight intervention system, said bridge apparatus comprising a cylindrical bridge element adapted to be disposed within said horizontal tree cap and having first and second spaced cylindrical elements adapted to seal against the tree cap and the tubing hanger respectively, said first and second spaced cylindrical elements defining an annulus cavity, a moveable valve element disposed in said tree cap intervention tool, said valve element being actuatable between a first and a second position such that, in said second position, said annular cavity provides communication from the annulus tubing of said xmas tree through said bridge to an annulus line in said housing disposed at the exterior of said housing, said bridge element preventing fluid communication between said annulus line and the main bore.

Conveniently, said bridge apparatus has a fishing neck profile at its upper end thereof.

According to yet a further aspect of the present invention, there is provided a lightweight intervention system for use with a conventional xmas tree, said lightweight intervention system comprising first lower coupling means for connecting to the top of said conventional xmas tree, a first housing coupled to the top of said first connector means and defining an interior bore for receiving a sub-sea completion tree, said housing being coupled to a second upper coupling means, said second upper coupling means being connected to said housing by a quick-connect/disconnect mechanism, said upper housing being adapted to be coupled to a riser stress joint, said riser stress joint, said first and said second couplings defining a main bore and an annulus bore.

Conveniently, said completion tree is coupled to said riser stress joint via a quick-disconnect coupling.

According to another aspect of the present invention there is provided a method of intervening in a well without using a BOP stack, said method comprising the steps of, running a lightweight intervention tool and coupling the same to a wellhead, removing a tree cap plug, providing annulus line and main bore communication, so that the annulus line is separated from the main bore, providing at least one valve element in said main bore which is actuatable to open and close said main bore, and controlling said annulus pressure to control operation of certain intervention system functions.

According to a further aspect of the invention there is provided a method of intervening in a well having a horizontal tree, said method comprising the steps of, providing a lightweight intervention tool, coupling the lightweight intervention tool to said horizontal tree at its lower end, and coupling the lightweight intervention tool to a dual bore riser at its upper end, removing the horizontal tree cap plug, installing a tubing annulus bridge in said main bore between said lightweight intervention tool, the tubing hanger and the tree cap, to provide annulus line communication from the horizontal tree to the lightweight intervention system, and to separate the annulus line from the main bore, and operating the annulus pressure to control certain intervention functions.

According to a further aspect of the present invention there is provided a method of intervening in a well having a conventional tree, said method comprising the steps of, providing a lightweight intervention tool and coupling the intervention tool between the conventional tree at its lower end and a dual bore riser at its upper end, providing a dual bore completion test tree within said intervention tool to provide continuity for a main bore and an annulus bore respectively from the tree to the riser, and operating at least one valve in the main bore and in the annulus bore to allow or prevent communication through said respective bores.

Preferably, said method includes the steps of providing coiled tubing gripping means in said intervention tool, and actuating said coiled tubing gripping means to move to a closed position in response to a valve in the main bore of said intervention tool being actuated to a closed position whereby, if coiled tubing passing through said intervention tool is cut by said valve, the cut tubing is gripped by said coiled tubing gripping means.

Conveniently, the cut coiled tubing can be removed by a fishing tool.

BRIEF DESCRIPTION OF THE DRAWING

These and other aspects of the present invention will become apparent from the following description when taken in combination with the accompanying drawings in which:

FIG. 3 is a view of the lightweight intervention apparatus of FIG. 1, including a coiled tubing grip and seal mechanism;

FIGS. 4*a,b* are cross-sectional views taken on the line 4—4 in FIG. 3, showing the grip and seal mechanism in open and closed positions respectively.

DETAILED DESCRIPTION OF THE PREFERRED EMBODIMENTS

Figure 1:
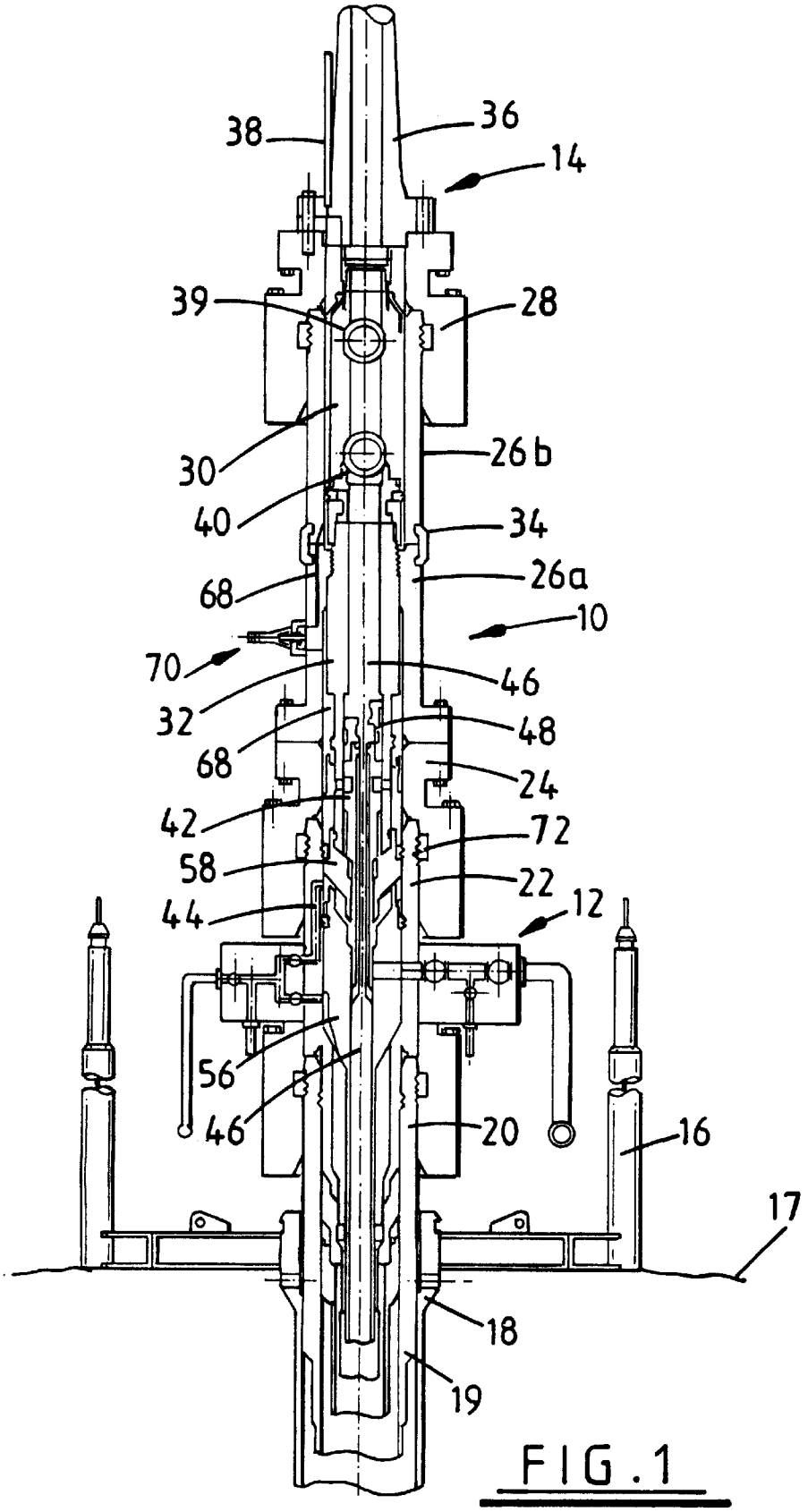
FIG. 1 is a longitudinal sectional view through a wellhead, xmas tree and lightweight intervention apparatus in accordance with a first embodiment of the present invention.

Reference is first made to FIG. 1 of the drawings which depicts a lightweight intervention package, generally indicated by reference numeral 10, coupled between a horizontal xmas tree 12 and an Expro proprietary coiled tubing riser 14, only part of which is shown.

In FIG. 1 there is shown a permanent guide base 16 which sits on the sea floor 17 and into which is located 30" casing 18. It will be seen that within the 30" casing 18 are concentric casings of reduced diameter which extend at successive depths into the sub-sea strata. The surface casing 19 extends to form the wellhead 20 on top of which sits the horizontal xmas tree 12. The horizontal xmas tree 12 is substantially as disclosed in applicants' co-pending Published International Application No. WO 95/17578. The horizontal xmas tree has an upper cylindrical mandrel 22 which is coupled to the lightweight intervention package 10 as will be later described in detail.

The lightweight intervention package 10 consists of five main parts:

a lower first wellhead connector 24 which is 18¾ internal diameter and which connects to the exterior of the xmas tree mandrel 22;

a cylindrical housing 26 formed of lower housing 26*a* and upper housing 26*b* and which define an internal diameter which is substantially the same of the xmas tree mandrel interior diameter;

an upper second 18¾" xmas tree connector 28;

a sub-sea test tree 30 with two ball valves as disclosed in Applicants' co-pending U.K. Application 9509547.7 located within the upper part of the housing 26*b* and also within the upper connector 26*b*, and a proprietary tree cap intervention tool 32 disposed in the lower part of the housing 26*b* and the top part of the first connector 24.

The housing parts 26*a*,26*b* are coupled together by a circular connector clamp 34 such as a Cameron clamp and the top connector 28 is coupled to a stress joint 36 which forms the bottom end of the tubing riser 14; the stress joint also receives coiled tubing 38.

It will be understood that the lightweight intervention apparatus 10 essentially replicates the pressure control functions of a blowout preventer (BOP) stack which weighs about 150 tonnes. The lightweight intervention apparatus 10 as described above weighs substantially less, being of the order of about 30 tonnes. This means that it may be deployed from a lightweight semi-submersible or mono-hull vessel which was hitherto not possible with blowout preventers, stacks etc.

As mentioned in the co-pending patent application for the horizontal tree, it is important that the system be tested prior to being exposed to well effluent and pressure. This can be achieved by operating the sub-sea test tree to ensure the integrity of the pressure connections and by pressure testing against the horizontal tree cap valve or plug.

Figure 2:
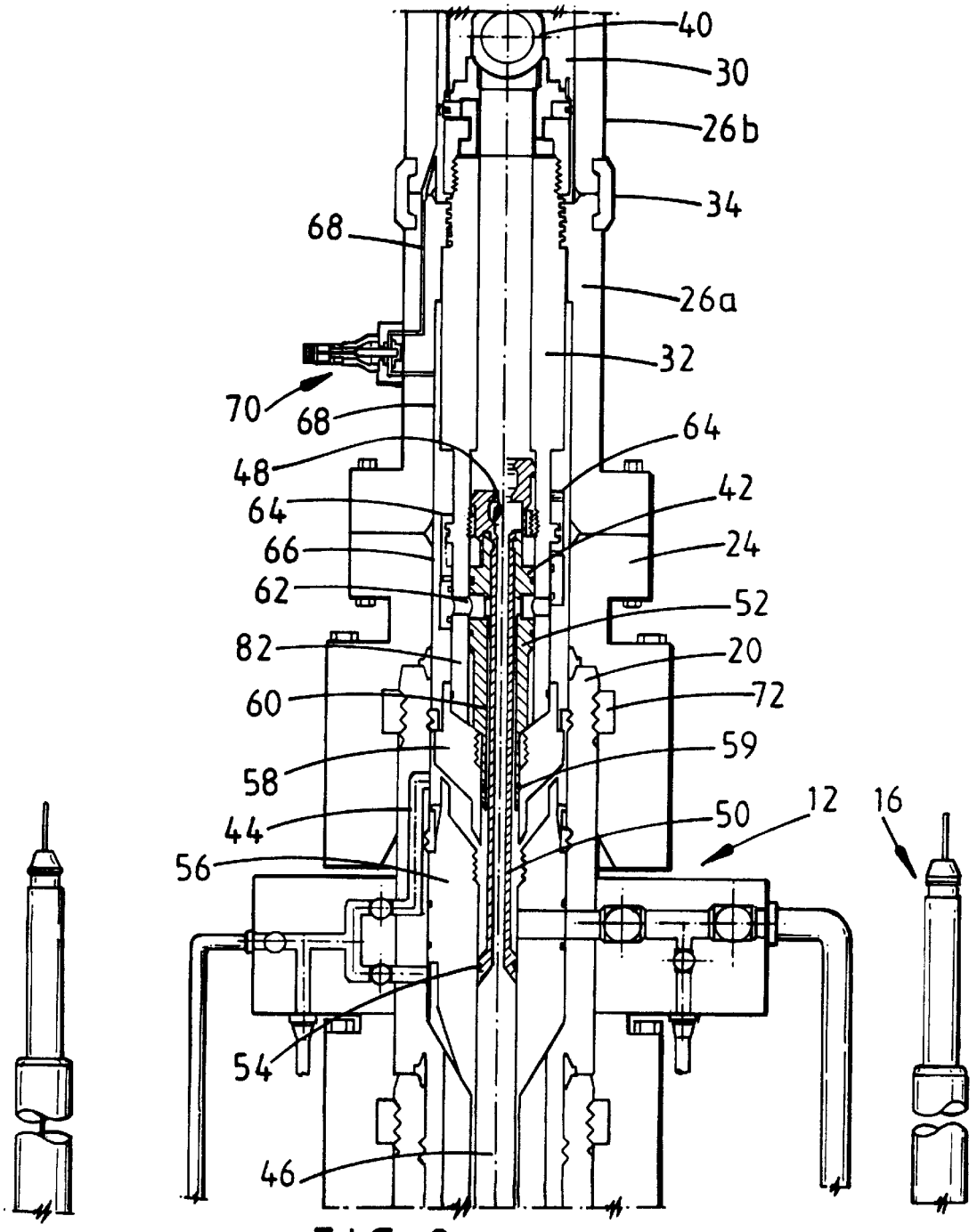
FIG. 2 is an enlarged and more detailed view of the annulus bridge shown in FIG. 1.

The procedure is to deploy the lightweight intervention package and locate it on the tree 12 as shown. After testing the pressure integrity of the system, the test tree valves 39,40 are opened, a wireline tool is run to pull the plug from the tree cap 58 and a second run made to pull the plug from the tubing hanger 56. Wireline can be run if needed, for example to insert a valve to facilitate flow or to provide a logging function. In the event that annulus communication to surface is required, then this is achieved by running a tubing annulus bridge, generally indicated by reference numeral 42 and which is best shown in FIG. 2 of the drawings. The tubing annulus bridge 42 is run on wireline and, as will be later described in detail, allows the annulus port 44 inside the horizontal tree 12 to be connected to the annulus void 68 within the lightweight intervention package 10 whilst being separated from the main bore 46 thus allowing control of the annulus for various functions such as pumping or stimulation operations via the crossover facility in the tree cap running tool 62, the annulus port 68 and the coiled tubing riser 38 to surface.

Reference is now made to FIG. 2 of the drawing which depicts, to a larger scale, the lower part of the lightweight intervention apparatus 10 with the tubing annulus bridge 42 installed in the main bore 46. It will be seen that the tubing annulus bridge 42 is generally cylindrical and has, at its upper end, a fishing neck profile 48 and first and second concentric elements 50,52 which are of different lengths. The interior longer element 50 is made of a sufficient length to sealingly engage via elastomeric seal 54 the tubing hanger 56 and the outer and shorter length 52 sealingly engages with the tree cap 58 via elastomeric seal 59 which is located within the horizontal tree 12 above the tubing hanger 56. The elements 50,52 of the bridge 42 define an annular cavity 60 which opens at the top end of the bridge 42 to register with an aperture 62 disposed in the bottom of the tubing hanger running/tree cap intervention tool 32. Aperture 62 is closeable by a sleeve 64 which is hydraulically actuatable to move longitudinally within an annular cavity 66 so as to cover or uncover the aperture 62 respectively. In the unactuated position (shown on the left of the bore 46) the sleeve covers the aperture 62 so that there is no communication from the annulus line 44 in the horizontal tree body 12 through the bridge 42 to the annulus line 68 located within the lightweight intervention apparatus 10. When the sleeve 64 is actuated it moves longitudinally upwards to clear the aperture 62, thus allowing annulus communication from line 44, through the bridge annulus 60 through aperture 62 to annulus 68 between the lower connector 24, housing 26*b* and the exterior of the tubing hanger running tool 32 which separate from the bore. A gate valve 70 is located in the annulus line 68 and this valve 70 can be actuated to isolate the annulus if required. The annulus line continues to travel within the housing 26*a*,26*b* and eventually mates with the coiled tubing 38.

It will be appreciated that the primary seal between the production bore and the intervention system is established with the installation of the intervention system on the horizontal xmas tree by the hydraulically actuated downward travel of the stinger 82 and its engagement with the horizontal tree mandrel 22. A further seal between the production bore 46 and the annulus cavity 44 is established when the bridge mechanism 42 is installed and seal 54 engaged with the tubing hanger 56 and seal 59 engages within the internal tree cap 58. When these two seals occur communication path between the annulus lines 44,68 is isolated from the main bore 46 of the tree below the internal tree cap 58 and the intervention system 10 is established, with the annulus lines being separate from the main bore.

Reference is now made to FIG. 3 of the drawings which depicts a view of a lightweight intervention system substantially identically to that shown in FIG. 2 with the like numerals referring to like parts for clarity and which has been modified to include coiled tubing gripping and sealing means, generally indicated by reference numeral 80 (which is shown 90° out of position in FIG. 3). It will be appreciated that this coiled tubing gripping and sealing means is, as can be best seen from FIGS. 4*a* and *b*, in the form of a pair of half shell elements 82,84 with interior bonded elastomeric seal elements 85*a,b* which are arranged to surround the coiled tubing 86 when actuated in a clam fashion so as to grip the tubing (FIG. 4*b*). In the normal unactuated position (FIG. 4*a*) the coiled tubing 86 is run through the lightweight intervention apparatus 10 as shown in FIG. 3. In the event that the ball valves 39,40 on the sub-sea test tree 30 are actuated to close, the valves cut the coiled tubing 86 which would normally fall into the well. Simultaneous actuation of the coiled tubing gripping and sealing means 80 forces the half shell elements 82,84 towards each other to grip the coiled tubing 86 as shown in FIG. 4*b*, thus preventing the coiled tubing from falling down the well and establishing a seal around the coiled tubing. If the sub-sea test tree valves 39,40 are then actuated to an open position, a fishing tool can be used to retrieve the coiled tubing 86 from the well. It will be appreciated that the coiled tubing gripping and sealing means is hydraulically actuated via hydraulic lines, not shown in the interests of clarity, which are carried through the interface of housing sections 26*a*,26*b*. Access into the annulus cavity between the coiled tubing and production tubing is achieved via a set of radial apertures 89, one of which is shown, in the housing 90 through which communication is achieved or denied by the position of hydraulically actuated sleeve 91. This is similar to the sliding sleeve valve mechanism described in the description of the bridge mechanism.

Figure 5:
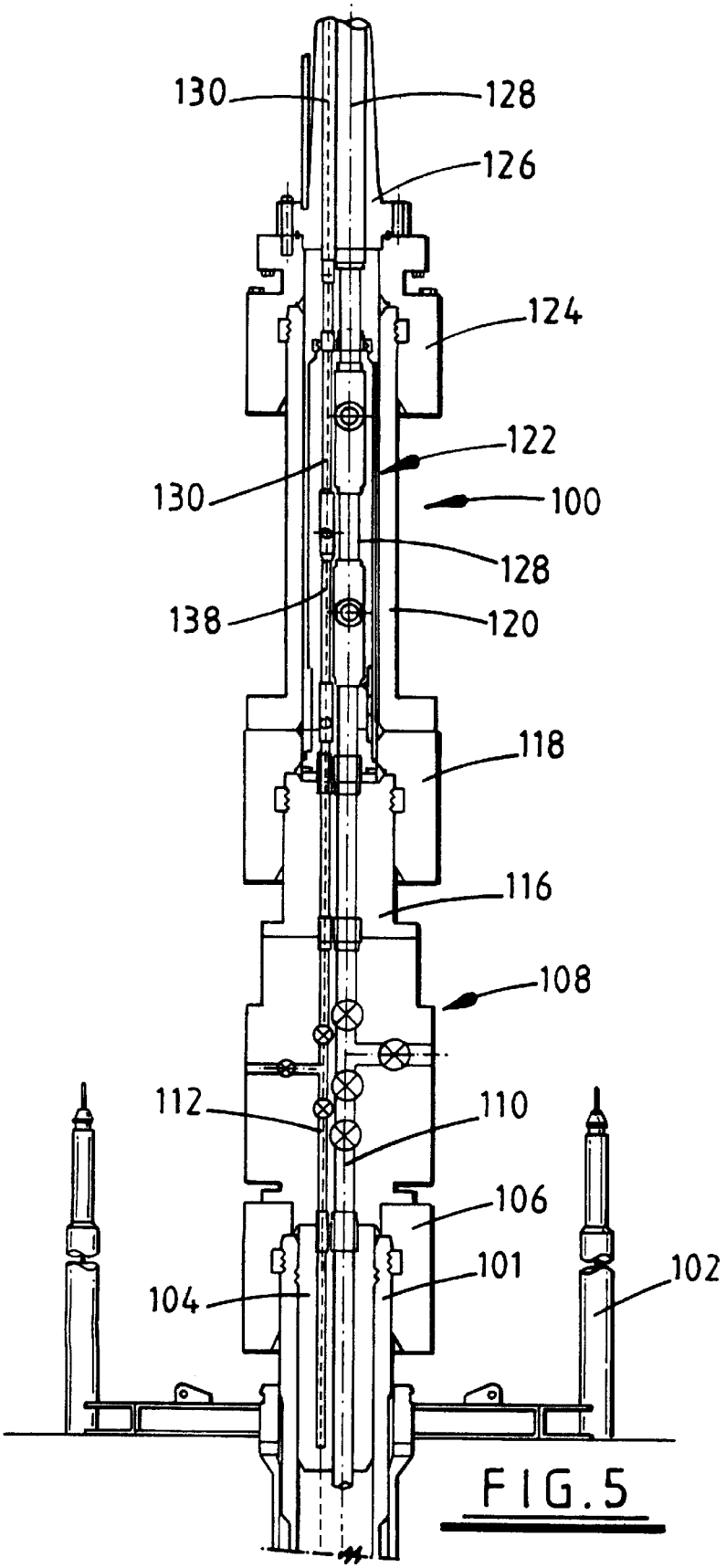
FIG. 5 is a longitudinal sectional view of a lightweight intervention system shown in use with a conventional parallel bore xmas tree in accordance with a further embodiment of the present invention.

Reference is now made to FIG. 5 of the drawings which depicts an alternative embodiment of a lightweight intervention system 100 used with a conventional parallel bore tree. In this case, the tubing hanger 104 is located within the top of the wellhead 101. A tree connector 106 sits on top of the wellhead and receives a conventional dual bore xmas tree 108 which has a production bore 110 and an annulus bore 112 and is of a type well known in the art. A re-entry hub 116 is located at the top of the xmas tree which, in turn, receives a first connector 118 of the lightweight intervention system 100 in a similar manner as hereinbefore described with the reference to the connector 24 in FIGS. 1 and 2. The connector 118 is secured to a top structural housing 120 of the lightweight apparatus 100 which, in turn, is coupled to a top coupler 124 which is a quick-connect/disconnect unit. The quick-connect/disconnect unit 124 is substantially similar to that described with reference to FIG. 1. The top unit 124 is coupled to a conventional stress joint 126 of a dual riser system.

Within the top structural housing 120 a dual bore completion sub-sea test tree 127 such as disclosed in applicant's co-pending Application No. 9509547.7 is located. Thus, in this arrangement, as will be seen from FIG. 5, the production bore 128 and annulus bore 130 are coupled straight through from the riser/stress joint 126 to the tubing hanger 104 located in the wellhead 101.

The sub-sea completion test tree 127 may be actuated to pressure test the connection to the tree and the valves may be actuated in the main bore and annulus line to seal the bores in the event of an emergency. The structural housing can be coupled to a bottom structural housing 120 which may also be configured to receive a wireline/coiled tubing gripping and cutting arrangement in the same manner as that disclosed with reference to the horizontal tree in FIGS. 1 to 4.

In addition, with the embodiment of FIG. 5 the riser may be implemented using the invention disclosed in applicant's co-pending U.K. Patent Application No. 9505129.8 for the dual bore riser. The advantage of this arrangement is that for 90% of lightweight interventions wireline access to the annulus is not required and the use of conventional premium tubing as the structural member of the riser to provide full bore access to the production bore and coiled tubing to enable full bore access to the tubing hanger annulus bore provides significant advantages as set forth in the co-pending application. The arrangement of the conventional tree together with the dual bore riser offers a number of advantages in providing wireline access if required and reduces the requirement for storage space and sophisticated handling equipment because the casing can be stacked in a more efficient space manner and the coiled tubing accommodated on the reel. Thus, the combination of the improved riser system and the lightweight intervention system avoids the need to have large and heavy equipment which requires complex and expensive handling and running equipment. The space on board a vessel is minimised and this also allows intervention from lightweight semi-submersible and mono-hull DP vessels.

Various modifications may be made to the embodiments hereinbefore described without departing from the scope of the invention. For example, in the lightweight intervention system shown in FIGS. 1 to 4 the housings 26*a*,26*b* may be replaced by a single unitary housing, though for convenience and to install the sub-sea tree and tubing hanger running tool or tree intervention tool a split housing is preferred. Other types of sub-sea test tree may be used than the standard Expro tree and the tree may control other than ball valves, for example flapper valves, plug valves or the like. In addition, the tubing hanger running tool could be modified to provide annulus access in combination with a bridge. The coiled tubing gripping and cutting means may be implemented by a different type of clamping arrangement, for example, a longitudinal mandrel which compresses the coiled tubing against one side of the bore. However, the arrangement shown in FIG. 3 is preferred as it will retain the tubing centrally in the bore and facilitate fishing of the cut tubing. With regard to the lightweight intervention embodiments shown in FIG. 5, as mentioned above, this can be modified to include a bottom structural housing and which may contain a coiled tubing gripping and cutting means in the main bore thereof.

Also, it will be understood that the intervention apparatus hereinbefore described may be used on a sub-sea wellhead directly for wells which are already abandoned or which are to be abandoned. In such cases, the horizontal or conventional tree will have already been removed. In such an arrangement the intervention apparatus may be coupled via the lower connecting means directly to the wellhead. For example, on an 18¾" subsea wellhead of the CIW type clamp hub design, an 18¾" Cameron type clamp-hub collect connector may be used to attach the intervention equipment to the wellhead. The intervention apparatus may include additional structural elements depending on the intervention operation required. For example, for an abandoned well with gas leakage between annular casings which requires re-cementing, an adaptor spool and cementing block valve assembly is located between the lower connector and the structural housing containing the sub-sea test tree (SSTT) with two ball valves in the main bore. As mentioned above, the SSTT provides primary pressure control barriers and can cut wireline, and an upper emergency disconnect package (EDP) is coupled between the structural housing and the riser. Such interventions can vary depending on the nature of the problem and the basic lightweight intervention package hereinbefore described is flexible and can be used in a number of different situations, although some additional equipment may be required for some particular situations, such as the cementation requirement outlined above.

Advantages of the present invention are that intervention operations can be carried out from lightweight semi-submersible and mono-hull DP vessels for a variety of purposes, such as well surveillance and management. With the systems hereinbefore described intervention can be carried out at a saving of at least 40–50% over existing semi-submersible based equipment. The lightweight intervention system when used in combination with the improved dual bore riser using coiled tubing offers a number of advantages including the minimising of storage space in the vessel and providing wireline access if required as well minimising the cost and avoiding the requirement of using specialised equipment. Because the system is lightweight and relatively fast to install it means that intervention operations can be carried out at a much greater rate on a number of wells and at lower cost.

I claim:

1. Lightweight intervention apparatus for use with a horizontal tree having a main bore and a separate annulus bore, said intervention apparatus comprising:

first connection means for connecting said intervention apparatus to said horizontal tree, housing means coupled to said first connection means, second connection means coupled to said housing means, said second connection means having a quick-connect/quick-disconnect facility, sub-sea test tree means located in said housing means in proximity to said second connection means, tree cap intervention tool means disposed in said housing means beneath said sub-sea test tree, said intervention apparatus providing main bore communication from a riser to said horizontal tree, said tree cap intervention tool means having valve means for providing annulus communication from said annulus bore in said horizontal tree.

2. Apparatus as claimed in claim 1 wherein the valve means connects the annulus bore to an annulus valve located in the intervention apparatus.

3. Lightweight intervention apparatus for use with a horizontal tree having a main bore and an annulus bore, said lightweight intervention apparatus comprising:

a first connector means for connecting the intervention apparatus to the horizontal tree, housing means coupled to the first connector means at one end and to second connector means at its other end, said second connector means being a quick-connect/disconnect connector and being adapted to be so connected to a riser stress joint, said housing means defining an interior bore in which is disposed at an upper end a sub-sea test tree and at a lower end a proprietary tree cap intervention tool selected so as to co-operate with a proprietary tubing hanger disposed in said horizontal tree, said proprietary tree cap intervention tool having coupling means for coupling with the main bore in said horizontal tree, and bridge means adapted to be disposed within said tree cap intervention tool to provide a communication channel between said annulus bore in the tree and the exterior of said housing and for isolating said annulus bore from said main bore.

4. Apparatus as claimed in claim 3 wherein said annulus bridge means is separately actuatable to provide said selectible communication between said annulus bore in said tree and the exterior of said housing when said bridge means is in place.

5. Apparatus as claimed in claim 3 wherein said sub-sea test tree has at least two spaced valves in said annulus bore.

6. Apparatus as claimed in claim 5 wherein said spaced valves are ball valves.

7. Apparatus as claimed in claim 3 wherein said housing is a two part housing having a lower housing part for receiving said proprietary tree cap intervention tool and an upper housing part for receiving said sub-sea test tree.

8. Apparatus as claimed in claim 6 wherein the two ball valves are located in series and are independently actuatable.

9. Apparatus as claimed in claim 6 wherein the intervention apparatus includes coiled tubing clamping means disposed within said housing, said coiled tubing clamping means being actuatable to clamp said coiled tubing in the event of said sub-sea tree being actuated to close said ball valves and cut said coiled tubing.

10. Apparatus as claimed in claim 9 wherein said coiled tubing clamping apparatus is provided by a pair of half shell elements which clamp around coiled tubing.

11. An annulus bridge apparatus for use with a lightweight intervention system to provide communication from an annulus in a horizontal tree having a tree cap and a tubing hanger disposed beneath the tree cap to an annulus line in the lightweight intervention system, said bridge apparatus comprising a cylindrical bridge element adapted to be disposed within said horizontal tree cap and having first and second spaced cylindrical elements adapted to seal against the tree cap and the tubing hanger respectively, said first and second spaced cylindrical elements defining an annulus cavity, a moveable valve element disposed in said tree cap, said valve element being actuatable between a first and a second position such that, in said second position, said annular cavity provides communication from the annulus of said horizontal tree through said bridge element to an annulus line in said housing disposed at the exterior of said housing, said bridge element preventing fluid communication between said annulus line and a main bore.

12. Apparatus as claimed in claim 11 wherein said bridge apparatus has a fishing neck profile at its upper end thereof.

13. A lightweight intervention system for use with a conventional xmas tree, said lightweight intervention system comprising first lower coupling means for connecting to the top of said conventional xmas tree, a first housing coupled to the top of said first connector means and defining an interior bore for receiving a sub-sea completion tree, said housing being coupled to a second upper coupling means, said second upper coupling means being connected to said housing by a quick-connect/disconnect mechanism, said second upper coupling means being adapted to be coupled to a riser stress joint, said riser stress joint, said first and said second upper coupling means defining a main bore and an annulus bore.

14. A system as claimed in claim 13 wherein said xmas tree is coupled to said riser stress joint via a quick-disconnect coupling.

* * * * *